United States Patent [19]

Rolland et al.

[11] 3,953,916

[45] May 4, 1976

[54] WIRE INSERTING AND TRIMMING APPARATUS

[75] Inventors: Claude Rolland, Argenteuil; Jacques Delalle, Verneuil sur Seine, both of France

[73] Assignee: AMP Incorporated, Harrisburg, Pa.

[22] Filed: May 19, 1975

[21] Appl. No.: 578,855

[30] Foreign Application Priority Data

May 22, 1974 France ..... 74.17985

[52] U.S. Cl. ..... 29/203 MW; 29/203 DT; 29/203 J

[51] Int. Cl.[2] ..... H01R 43/04

[58] Field of Search ... 29/203 MW, 203 DT, 203 D, 29/203 H, 203 J, 33 M, 628

[56] References Cited

UNITED STATES PATENTS 3,866,296 2/1975 Tucci ..... 29/203 MW 3,886,641 6/1975 Davis ..... 29/203 MW

*Primary Examiner*—Carl E. Hall

*Attorney, Agent, or Firm*—William J. Keating; Jay L. Seitchik; Frederick W. Raring

[57] ABSTRACT

Wire insertion and trimming apparatus comprising two wire locating combs opposed on opposite sides of a connector-supporting bed, a wire insertion and trimming ram reciprocable relative to the bed, and a third comb movable from a position remote from the bed to a position adjacent the bed to permit loading the connector onto the bed and wire insertion. Preferably, means are provided to latch the third comb remote from the bed which means are releasable by loading a connector and the two combs are movable after wire insertion in cooperation with the latching means to eject the connector.

12 Claims, 15 Drawing Figures

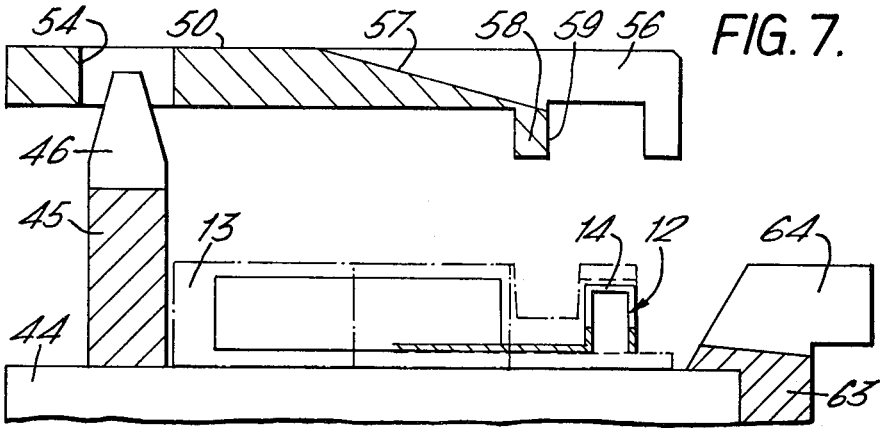
FIG. 7.
FIG. 8.
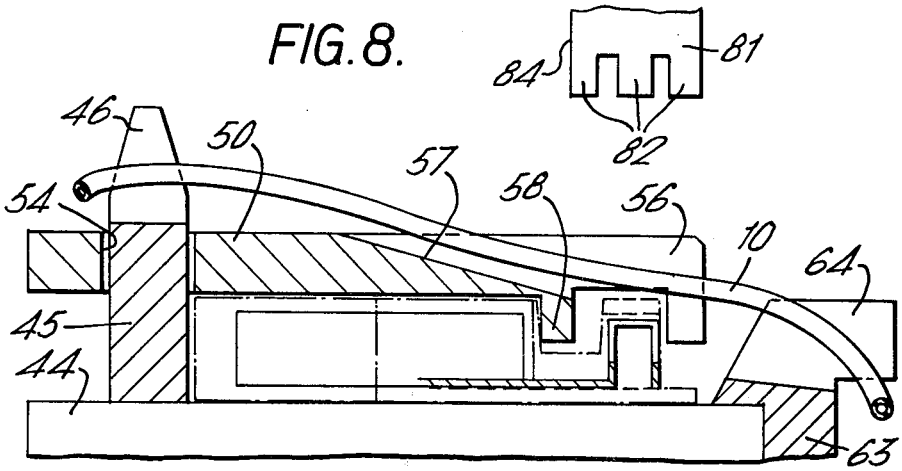
FIG. 9.
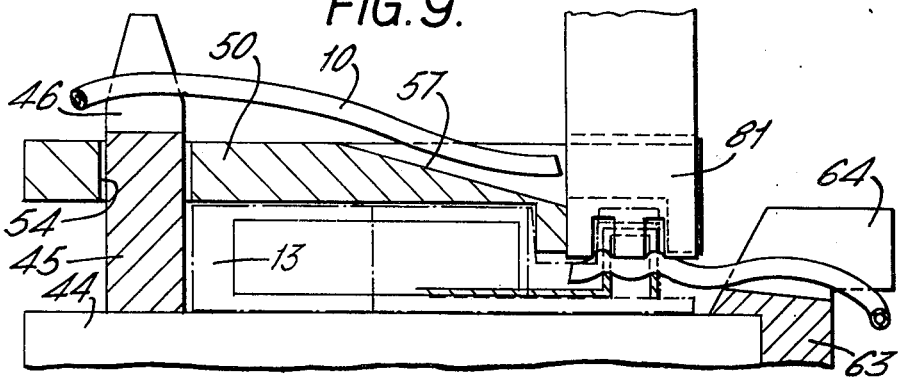

WIRE INSERTING AND TRIMMING APPARATUS

The invention relates to apparatus for inserting insulated wires simultaneously into wire-receiving slots formed in terminals mounted in a connector housing to electrically connect the wires to the terminals and for trimming the wire ends.

According to the invention the apparatus comprises first and second wire-receiving combs upstanding from opposite sides of a connector supporting surface with their teeth in alignment, a wire insertion and trimming ram reciprocable relative to the supporting surface along a path extending between the combs and is characterized in that, the apparatus is for use with connectors having substantially flat housings the terminal slots extending perpendicularly to the plane of the housings, the supporting surface comprising a block or bed adapted to locate the connector housing to extend in a horizontal plane, a third wire locating comb being mounted for movement from a position remote from the block or bed to permit loading of the connector housing into the apparatus to a position adjacent the block or bed overlying the connector housing and in which the teeth are aligned with the teeth of the first and second combs and the terminal slots of the connector.

Embodiments of the invention will now be described by way of example, with reference to the accompanying drawings in which:

FIGS. 7, 8 and 9 are diagrammatic fragmentary cross-sectional views corresponding generally to FIGS. 3, 5 and 6 and showing successive stages of the trimming and termination operation;

Figure 2:
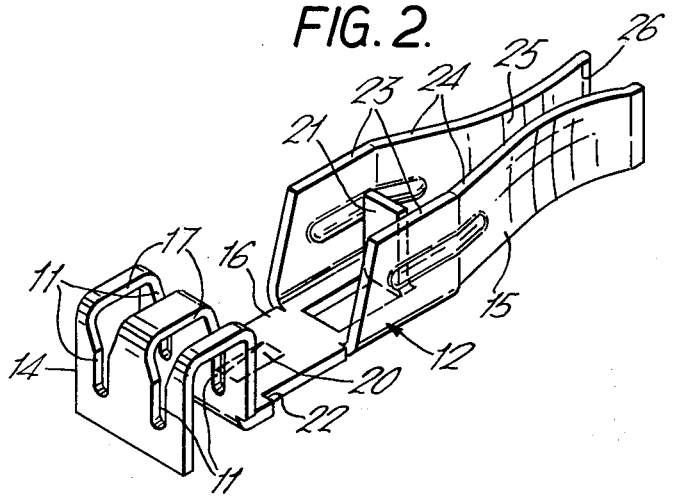
FIG. 2 is an enlarged perspective view of a terminal used in the connector of FIG. 1.
Figure 1:
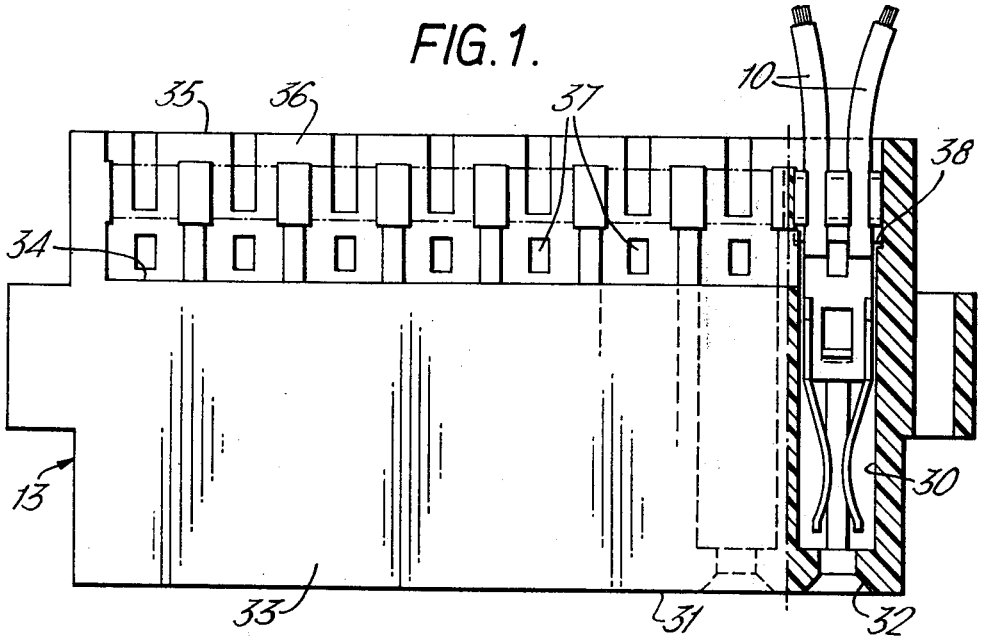
FIG. 1 is a partially sectional top plan view of an electrical connector terminating a plurality of wires.

With reference firstly to FIGS. 1 and 2, the present invention is particularly intended to trim insulated conductor wires 10 and insert the trimmed wires into slots 11 of terminals 12 which are contained in a housing 13 made of an insulating plastics material.

Each terminal comprises a wire-connecting portion 14 and a contact portion 15 joined by an intermediate portion 16. The wire-connecting portion 14 is substantially U-shaped and each arm of the U has two slots 11 each of which has an enlarged mouth intersecting the base of the U. The two slots 11 of one arm are respectively aligned with and joined to the two slots 11 of the other arm by means of two slots 17 along the base of the U.

The intermediate portion 16 is formed as a plate from which is struck a locking lance 20 and a stop member 21. The plate 16 is formed with recessed shoulders 22.

The contact portion 15 comprises two parallel plates 23 upstanding from respective longitudinal edges of the plate 16. Contact arms 24 are cantilevered from the plates 23 and bowed towards each other to define a constricted contact area 25 and a divergent mouth 26.

The housing 13 has a plurality of cavities 30 opening onto the rear of the housing and communicating with a forward face 31 of the housing by means of circular holes 32. An upper wall 33 of the housing has a rear edge 34 which stops short of a rear edge 35 of a lower wall 36 of the housing. The lower wall 36 has a plurality of through holes 37 aligned respectively in the cavities 30. The walls of the cavities 30 are recessed to provide shoulders 38.

Each cavity receives a terminal 12 such that the lance 20 is received in the respective hole 37 to prevent withdrawal and the shoulders 22 of the terminal engage the cavity shoulders 38 to limit insertion of the terminals. The mouth 26 of the contact portion is aligned with a hole 32 and the wire-connecting portion 14 is positioned rearwardly of the rear edge 34 of the housing wall 33.

Apparatus 40 for applying the wires 10 to the terminals 12 of the connector comprises a base 41 and an insertion device 42 adapted to be removably mounted on the base.

The base 41 is generally rectangular and comprises a permanently magnetized lower block 43 surmounted by an upper jig block or bed 44. On the upper surface of the jig block 44 there is provided a vertical comb 45 extending parallel to and proximate a rear edge of the jig block 44. The comb 45 has equally spaced teeth 46 which extend vertically downwardly from an upper edge of the comb to define wire-receiving spaces.

A plate 50, spaced above the upper surface of the jig block 44 is carried on two spaced hollow posts 51 which are slidably received in holes in the jig block 44. The plate 50 is biased to an upward spaced position relative to the jig block by means of two spaced coil springs 52 which respectively surround two guide pins 63 carried by the plate and slidably received in holes in the jig block. The plate 50 is generally rectangular with a slot 54 complementary with and aligned with the rear comb 45.

A comb 55 forms a forward edge portion of the plate 50, the comb 55 lying generally in the plane of the plate and having teeth 56 which are aligned respectively with the teeth of the rear comb 45 and which extend horizontally rearwardly from a forward edge of the comb to define wire-receiving spaces.

As can be seen in FIG. 7 the teeth 56 extend further along the upper surface of the comb 55 than along the lower surface, the wire-receiving spaces terminating in respective sloping surfaces 57. Furthermore, the teeth 56 also extend vertically downwardly from the comb at its forward edge, the downwardly projecting portions being spaced from an integral cutter bar 58 projecting from the lower surface of the comb 55 at the position where the sloping surfaces 57 intersect the lower surface of the comb. The forwardly facing surface 59 of the cutter bar 58 acts as a shear surface as described below.

The upper surface of the plate 50 is provided with two spaced projections 61 each of which has a vertically extending curved channel 62 provided along a forward edge and aligned and extending into a respective one of the hollow posts 51.

A further comb 63 is fixed to the forward surface of the jig block 44 and has teeth 64 which are aligned respectively with the teeth of the combs 45 and 55 and which extend vertically downwardly from an upper edge of the comb 63 to define wire-receiving spaces. The teeth 64 also extend horizontally forwardly of the comb 63 thus to overhang the forward face of the comb 63. A wiring aid plate 65 extends horizontally below the teeth 64 and is secured to the comb 63 by means of a bracket 66. The plate 65 is marked off in sections which are aligned with successive pairs of wire-receiving spaces defined by the combs and which may also be numbered to assist the operator in threading the wires as described later.

A plate 67 is mounted to each side of the jig block 44. Each plate 67 has a slot 68 extending inwardly from an upper forward corner of the plate, the slot having a constricted portion 49 and terminating in a rounded enlarged portion 70.

A locking bar 72 is slidably received in a slot extending inwardly of one of the sides of the lower block 43 at its junction with the jig block 44. The locking bar is shaped at its inner end (not shown) to engage latchingly the pins 51 when the plate 50 and the pins 51 are pushed downwardly to prevent movement of the plate 50. The automatic latching action causes the locking bar 72 to move outwardly.

The insertion device 42 comprises a yoke-like frame having two side rails 73 depending from a cross-head 74. Near the free end of each rail 73 there is provided a short pin 75 which extends laterally through the rail. An insertion head 76 is slidably mounted between the rails 73 and is carried on the end of a pneumatic ram 77 slidably in a cylinder 78. Two spaced guide pins 79 are carried by the insertion head 76 and are slidably received in holes in the cross-head 74. The pins are so spaced and dimensioned to be receivable in the channels 62 of the plate 50 and the pins 79 are so spaced and dimensioned to be receivable in the slots 68 of the side plates 67.

The insertion head 76 is provided along its lower surface with a row of spaced insertion teeth 81. As seen in FIGS. 8 and 9 each tooth 81 is recessed on its leading edge to define three downwardly projecting spaced stuffer portions 82. The left-hand surface 84 as seen in FIGS. 8 and 9 acts as a shear surface as described below.

Figure 3:
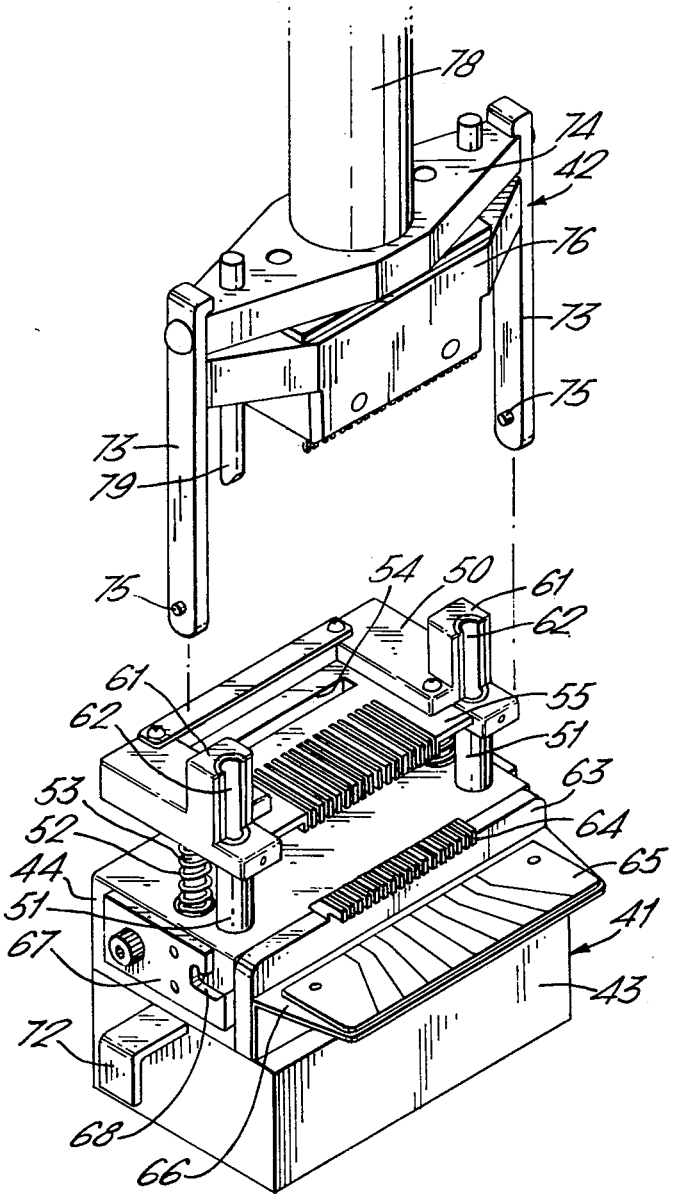
FIG. 3 is a perspective view showing the essential lacing a plurality of conductors.
Figure 4:
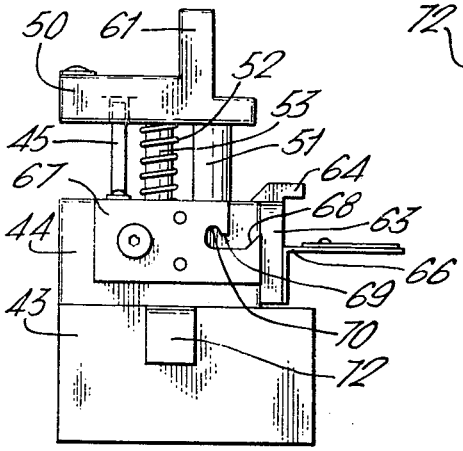
FIG. 4 is a side view of the base part of the apparatus of FIG. 3, prior to loading a connector.

In use, the base 41 is secured to a steel mounting table under the action of the magnetic block 43. With the plate 50 and the comb 55 in the upper position as seen in FIGS. 3 and 4, a connector as shown in FIG. 1 is inserted into the space defined by the three combs and the upper surface of the jig block 44, the connnector with its housing wall 36 resting on the upper surface of the block 44 and with the housing wall 31 hard up against the comb 45 as seen in FIG. 7.

Figure 5:
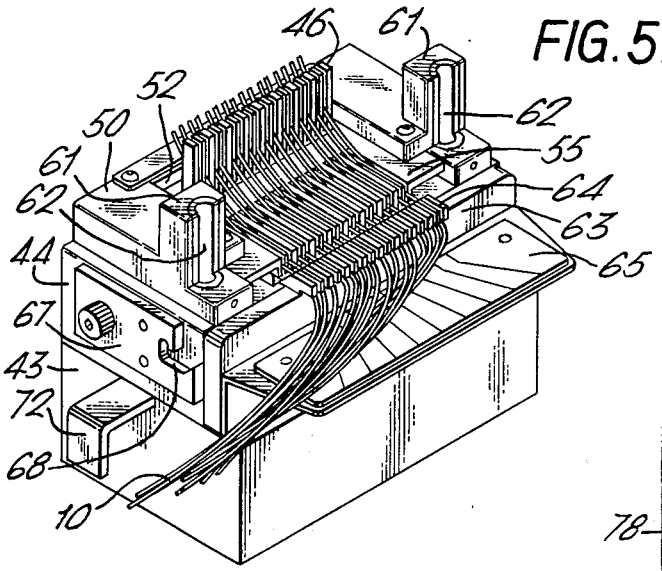
FIG. 5 is a perspective view of the base part of the apparatus of FIG. 3 after loading a connector and lacing a plurality of conductors.

The plate 50 is then pressed down manually against the springs 52 into engagement with the upper surface 33 of the connector housing to the position shown in FIGS. 5 and 8, causing the locking bar to be pushed outwardly and maintain the plate 50 in the lower position. In this position the comb 45 projects through the slot 54 in the plate 50.

Figure 6:
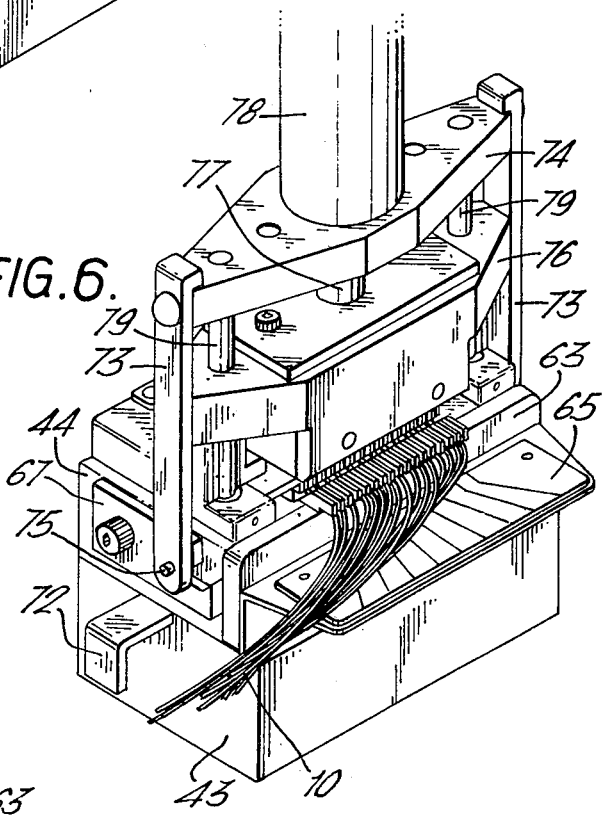
FIG. 6 is a perspective view of the apparatus of FIG. 3 in assembled form during termination of a plurality of wires to a connector.

The pneumatic ram 77 is then actuated, driving the insertion head 76 downwardly to the position shown in FIG. 6, the pins 79 serving to guide the head. The insertion teeth 81 of the insertion head are aligned with the spaces between the teeth 56 of the comb 55, and with the slots 17 in the terminals 12. Furthermore, the spaces between the stuffer portions 82 are aligned with the arms of the U-shaped wire-connecting portions 14 of the terminals 12. Thus, when the insertion head descends, the teeth 81 engage respective wires 10 and as the shear surface 84 moves past the shear surface 59 of the cutter bar 58 the wires 10 are trimmed. The stuffer portions 82 then stuff the trimmed end portions of the wires 10 into the slots 11 of the terminals as seen in FIG. 9. The spaces between the stuffer portions 82 accommodate the arms of the U-shaped wire-connecting portion to enable complete stuffing.

After retraction of the ram 77, the insertion device 42 is unlatched from the base 41, and the locking bar 72 is pushed manually inwardly to release the plate 50 and comb 55 which return to their upper position to enable the fully terminated connector to be removed.

In the second example, shown in FIGS. 10–14, the base 86 includes a box-like frame defined by an upper horizontal plate 87 providing a support surface or bed for a connector and fixed spaced apart from a lower plate 88 by vertical front and rear side frame members 89, 90 respectively.

A platen 91 carrying front and rear wire-locating combs 93 and 94, respectively, which extend through apertures 95 and 96, respectively, formed in the upper plate, is located within the frame against a lower surface of the upper plate by compression springs 97. The platen also carries connection locating pegs 98 which extend through apertures in the upper plate.

The front comb 93 is of triangular plan having vertical teeth 101 aligned with vertical teeth 102 of the rear comb, and is located in aperture 95 by a triangular locating plate 103, clamped in situ by a wiring aid plate 104. This enables the comb to be replaced by a similar comb having a different number of teeth or its orientation to be reversed when it is desired to dress wires from the opposite side of the apparatus. A wire ejector plate 130 upstands from the bed adjacent the comb 94.

A platen shift mechanism comprises a handle 106 connected between ends of lever arms 107 the other ends of which are pivotally mounted on pins 108 extending horizontally from opposite front side frame members 89. A rod or trunnions 99 fixed to opposite sides of the platen is received as a free fit in slots 100 formed towards the other end of the lever arms 107 so that depression of the handle causes downward movement of the platen and hence the combs and connector locating pins.

A further wire locating comb 109 is mounted transversely on two arms 110 intermediate their ends, the arms being mounted at one end on a shaft 111 pivotally mounted in ears 112 attached to the rear of the upper plate 87. A cutter or shear bar 113 is mounted transversely on the arms to extend through the lower part of the comb and has enlarged ends 114 which define with a pair of blocks 115 fixed to the free ends of the arms 110, guide channels 116 for an insertion head 117. A wiring aid plate is rotatably mounted to extend transversely between the arms 110, rotation of the aid plate indicating different wiring positions.

Figure 10:
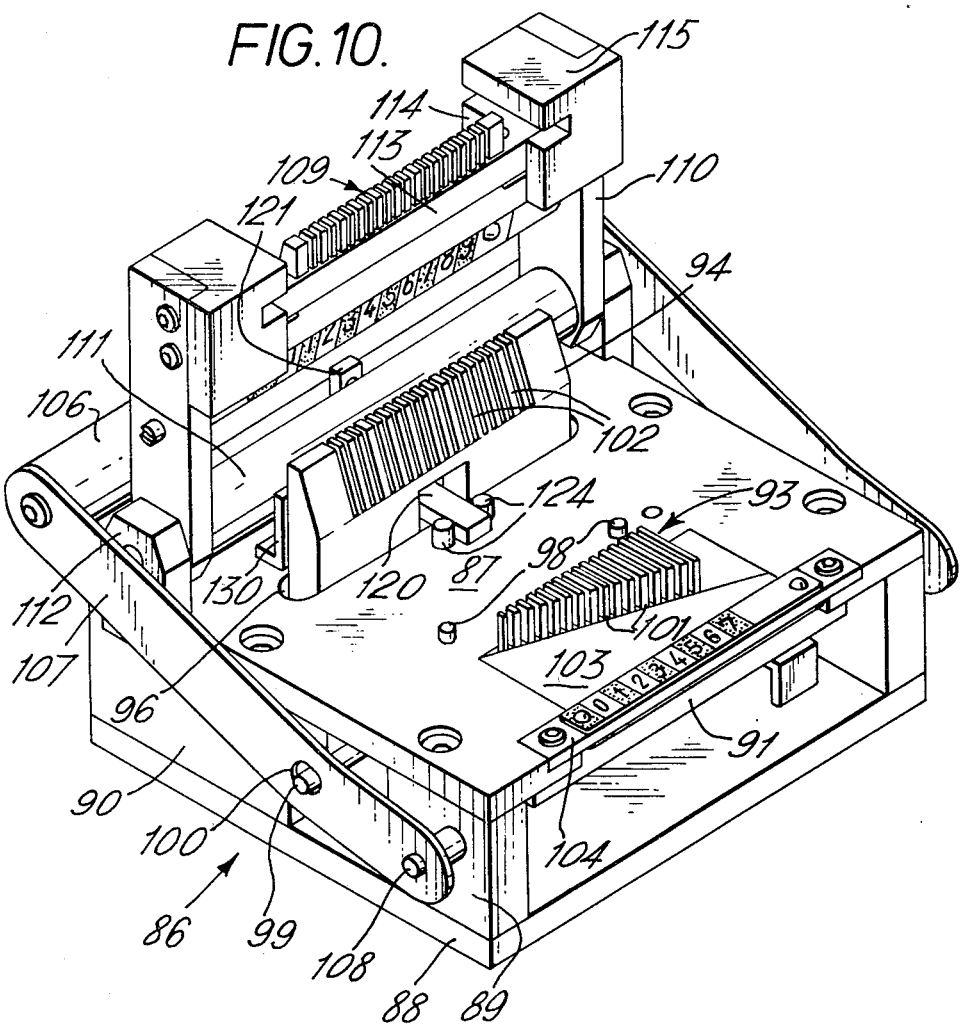
FIG. 10 is a perspective view of the base part of a second embodiment of insertion apparatus prior to loading a connector.
Figure 11:
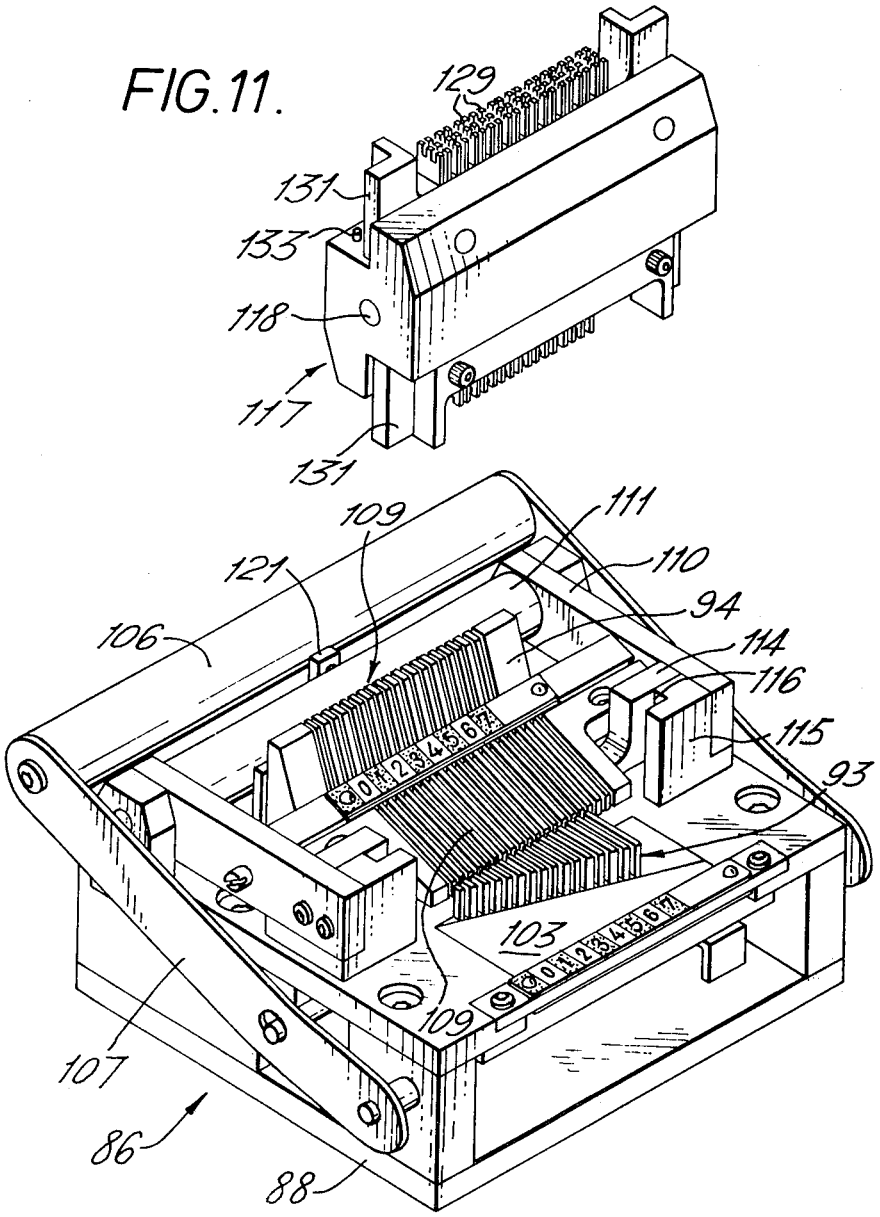
FIG. 11 is a perspective view of the apparatus shown in FIG. 10 after loading a connector, showing also the insertion head.
Figure 12:
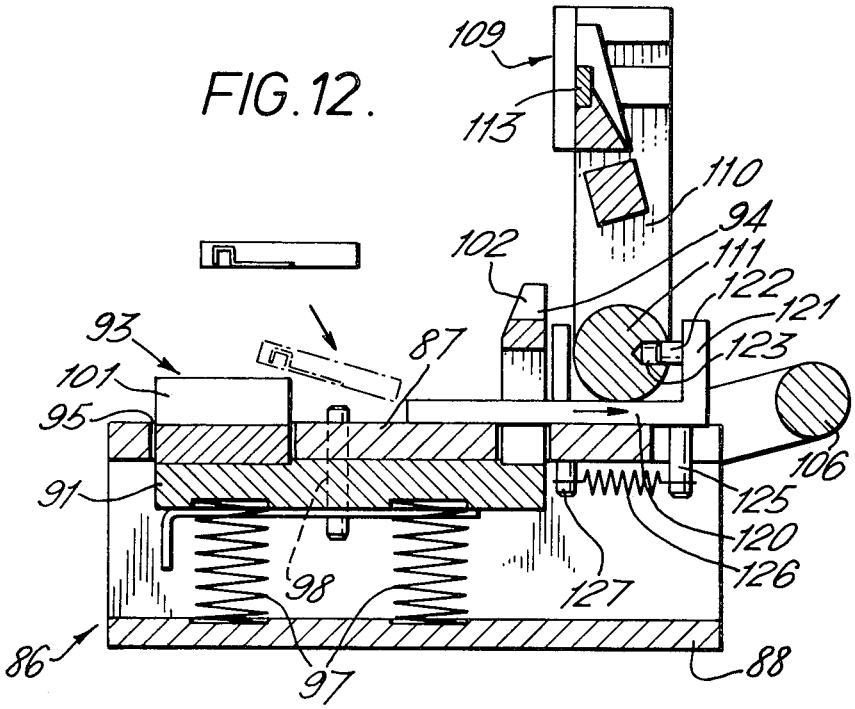
FIGS. 12–15 are diagrammatic cross-sectional views showing successive stages of the connector and wire loading, insertion and trimming, and ejection operation.

A latch bar 120 having an upturned end 121 carrying a latch detent 122 receivable in an aperture 123 in the shaft 111 to prevent inadvertent pivotal movement of the wire locating comb from the position of FIG. 10 to the position of FIG. 11, is located against the upper surface of plate 87 for longitudinal sliding movement, at one end between posts for longitudinal sliding movement, at one end between posts 124 upstanding from plate 87. The other end of the bar carries a downwardly extending post 125 fixed to one end of a tension spring 126, the other end of which is attached to a post 127 fixed to the underside of the plate 87.

A double headed inserter 117 is provided and can be mounted on a yoke (not shown) by trunnions received in sockets 118 on each side of the inserter. Each head 119 has a different number and arrangement of insertion teeth 129, rotation of the inserter through 180° enabling either head to be used. On opposite sides of each head are provided tapered guide rails 131 initially receivable as a free fit in the guide channels 116 when the comb 109 is pivoted to the horizontal loaded position, but which form a sliding fit towards the end of the downward travel of the inserter. Spring loaded pins 133 are provided adjacent the guide rails 131.

Figure 13:
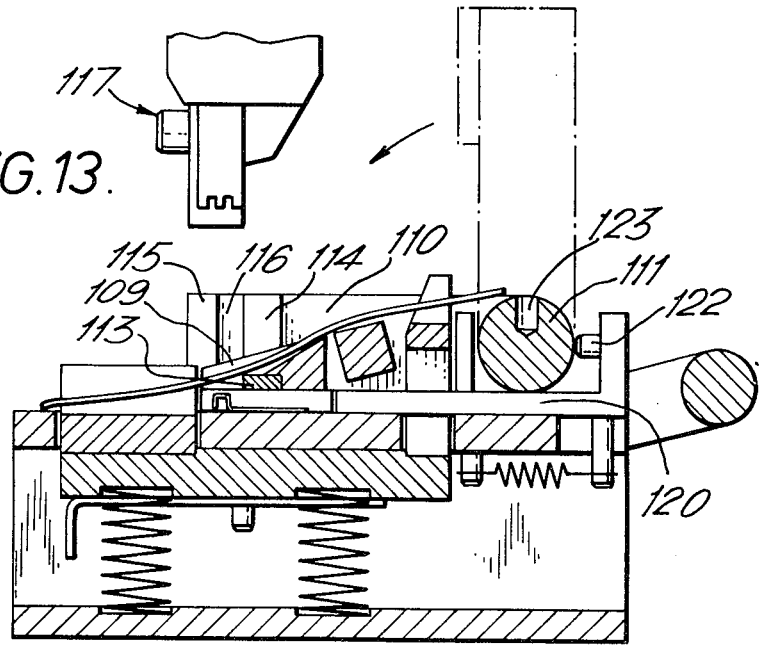
Figure 14:
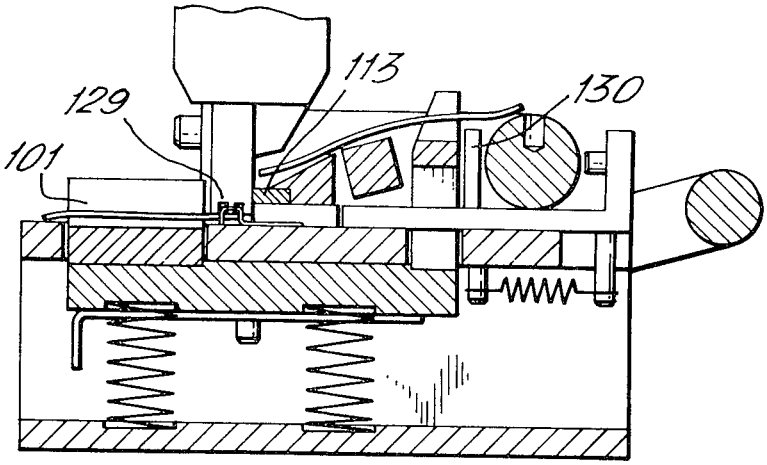
Figure 15:
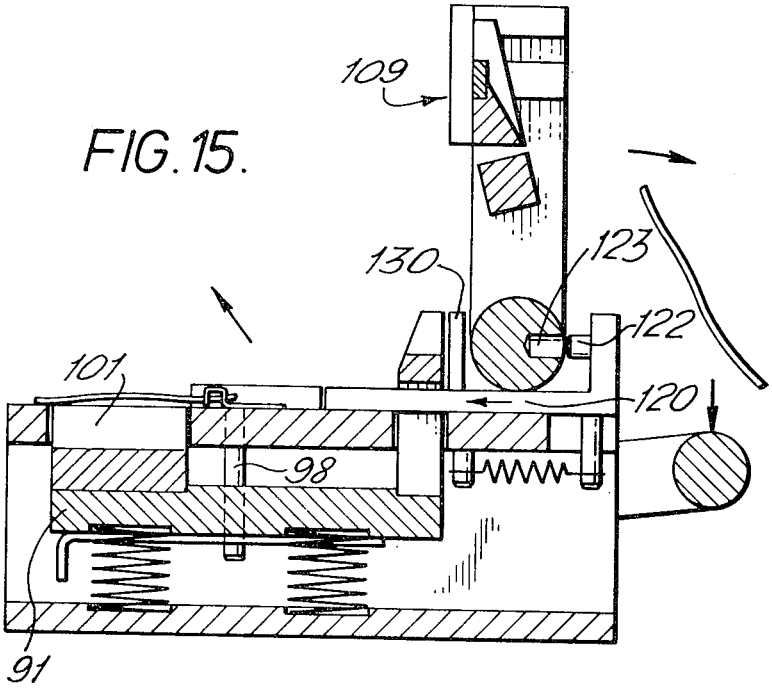

A connector is loaded into the apparatus with the comb 109 in a vertical position remote from the upper surface of the plate 87. During loading the front face of the connector pushes the latch bar 120 rearwardly against the action of spring 126 to withdraw the detent 122 from socket 123 to release the shaft 111. The connector is then securely clamped on the surface of the plate 87 between the front of the latch bar and the pegs 98. The comb 109 is then pivoted to a horizontal position to overlie the connector (as shown in FIG. 13) and insulated wires 10 are loaded into the three combs to extend aligned with the slots 11. A pneumatic ram (not shown) is then actuated to drive the insertion head downwardly to trim (in cooperation with cutting or shear bar 113) and stuff the wires into the slots. The comb 109 is then raised and the handle 106 depressed to lower the platen 91 and hence the combs and locating pegs permitting the spring to return the latch bar to eject the connector and the detent 122 to re-enter the socket 123. Lowering of the combs also causes the ejection plate 130 to eject the severed ends of the wires.

What is claimed is:

1. Apparatus for inserting insulated wires simultaneously into wire receiving slots formed in terminals mounted in a connector housing to electrically connect the wires to the terminals and for trimming the wire ends, comprising first and second wire-receiving combs upstanding from opposite sides of a horizontal connector bed with their teeth in alignment, a wire insertion and trimming ram reciprocable relative to the bed and along a path extending between the combs, a third wire-receiving comb mounted for movement from a position remote from the bed to permit loading of the connector onto the bed to a position adjacent the bed overlying the connector when so loaded and in which the teeth are aligned with the teeth in the first and second combs and the terminal slots.

2. Apparatus according to claim 1 in which the third comb is spring biased to the position remote from the bed and is latchable adjacent the bed to clamp the connector housing on the bed.

3. Apparatus according to claim 1 in which the third comb is mounted on a plate supported above the bed, the plate having a slot through which the second comb projects.

4. Apparatus according to claim 1 in which the insertion ram includes a pair of spaced parallel guide members for the insertion head, the members having on their facing sides projections receivable in respective grooves in the sides of the bed.

5. Apparatus according to claim 4 in which the insertion head carries pins slidably receivable in channels in the bed.

6. Apparatus according to claim 1 in which the third comb has a shearing surface at the roots of the teeth and directed generally towards the second comb, the shearing surface being cooperable with the shearing surface on the insertion head.

7. Apparatus according to claim 1 in which the third comb is mounted for pivotal movement towards and away from the bed.

8. Apparatus according to claim 7 in which latching means are provided to maintain the comb remote from the bed, which means are releasable by engagement with a connector housing when loaded onto the bed.

9. Apparatus according to claim 8 in which a latching bar is resiliently biased to extend across the bed and movable by the connector housing against the spring action to release the latching means.

10. Apparatus according to claim 7 in which the first and second combs are mounted on a platen located beneath the bed and extend through apertures in the bed, the platen being resiliently biased towards the bed, and lever means being provided to depress the platen.

11. Apparatus according to claim 10 in which connector locating pegs are mounted on the platen to extend through apertures on the bed defining with the latch arm a connector locating clamp, depression of the lever means causing ejection of the connector housing from the bed by the latch arm.

12. Apparatus according to claim 10 in which a wire ejection plate upstands from the bed at a location adjacent the second comb.

* * * * *